US007594774B2

(12) United States Patent
Kronenberger

(10) Patent No.: US 7,594,774 B2
(45) Date of Patent: Sep. 29, 2009

(54) WRITING INSTRUMENT WITH FOUNTAIN PEN CONFIGURATION

(76) Inventor: Robert Kronenberger, 1180 Hamilton, Deerfield, IL (US) 60015

( * ) Notice: Subject to any disclaimer, the term of this patent is extended or adjusted under 35 U.S.C. 154(b) by 317 days.

(21) Appl. No.: 11/024,183

(22) Filed: Dec. 28, 2004

(65) Prior Publication Data

US 2006/0140705 A1 Jun. 29, 2006

(51) Int. Cl.
*B43K 7/00* (2006.01)
*B43K 7/03* (2006.01)

(52) U.S. Cl. ..... 401/209

(58) Field of Classification Search ..... 401/208, 401/209, 212, 216, 221
See application file for complete search history.

(56) References Cited

U.S. PATENT DOCUMENTS 2,487,340 A * 11/1949 Kleinsmith ..... 401/216
2,902,978 A * 9/1959 Legnani ..... 401/4
3,352,621 A * 11/1967 Fehling et al. ..... 401/109
4,168,129 A * 9/1979 Herrnring ..... 401/243
4,225,256 A * 9/1980 Rosler et al. ..... 401/209
6,328,496 B1 * 12/2001 Hill et al. ..... 401/209

FOREIGN PATENT DOCUMENTS

DE 3629899 A1 * 3/1988

* cited by examiner

*Primary Examiner*—Huyen Le
(74) *Attorney, Agent, or Firm*—Wood, Phillips, Katz, Clark & Mortimer

(57) ABSTRACT

A writing instrument has a barrel and a tip section through which a writing substance is applied by the writing instrument. The barrel has a shape that is graspable in the hand of a user so as to allow the tip section to be moved against a surface to controllably supply a writing substance thereto. The tip section has a tip assembly that one of (a) is a nib of a fountain pen and (b) simulates in appearance a nib of a fountain pen. The tip section has a barrel end and a writing substance applying end. The writing instrument further includes a writing substance applying assembly. The writing substance applying assembly has a surface contacting end and a supply of a writing substance that is applied to a surface by bearing the surface contacting end against the surface. The writing substance applying assembly functions to supply the writing substance to a surface without the tip section performing a normal nib function for a fountain pen.

31 Claims, 5 Drawing Sheets

WRITING INSTRUMENT WITH FOUNTAIN PEN CONFIGURATION

BACKGROUND OF THE INVENTION

1. Field of the Invention

This invention relates to writing instruments and, more particularly, to writing instruments that have configurational aspects of, but operating components different than, a fountain pen.

2. Background Art

Fountain pens have been in existence since the early 1700's. There are certain configurational aspects of fountain pens that distinguish them from other writing instruments. Most notable of these features is the nib, which directly contacts the surface to which ink is to be applied. In its earliest form, the fountain pen contained a nib that was repeatedly dipped into an ink supply preparatory to usage. In the 1800's, several different types of reservoirs for the ink were developed. The reservoirs were designed to be refilled through any of myriad different mechanisms.

Fountain pens have stood the test of time and remain symbolic of status and prestige. Prominent statesmen from years past are commonly shown in paintings and historical memoirs signing significant documents with fountain pens. Even to this date, to commemorate historically significant events, the President of the United States is frequently shown in ceremonies signing documents, such as significant new legislation, treaties, etc., using a fountain pen.

Aside from the historical significance that fountain pens have, they are also desirable in certain respects from a utility standpoint. The nib of a fountain pen is designed so that a single nib construction permits the user thereof to selectively vary the width of the ink line by changing the orientation of the nib and the pressure applied thereto. Still further, the fountain pen is preferred for its ability to smoothly glide against the surface upon which ink is applied. Even moving at a fairly rapid speed, the fountain pen may be able to evenly apply ink to produce homogeneous and intense colors.

The nib of the fountain pen is unique in the writing instrument field in that it actually adapts to a particular user by wearing slighting to conform to a surface at a particular user angle. Whereas most writing instruments are designed with a universal shape and size, fountain pens are commonly customized for a particular hand. The barrel of the fountain pen may be customized for each individual by controlling the overall diameter, the shape of the grip region on the barrel, the length of the barrel, etc., to allow an ergonomically appropriate feel for consistent angle of attack and consistent, controlled movement by that individual.

Over the course of time, the fountain pen has become more than a functional item. The interest in fountain pens has spawned an ever increasing group of collectors that are seeking out not only historic designs, but new designs incorporating new materials, shapes, ornamentation, etc. True aficionados seek fountain pens from different ages, historically significant fountain pens, and fountain pens that are modern and unique in their design and functionality.

There is a large segment of the population that has an interest in the appearance of the fountain pen, but does not want to contend with certain of the problems associated therewith. For example, carrying a fountain pen in an airplane in which the fountain pen will be exposed to a severe environmental pressure change could case ink leakage. Further, refilling may be an inconvenience that certain users of writing instruments do not wish to contend with.

Heretofore, those persons that like the physical appearance of fountain pens, but do not wish to deal with certain functional aspects thereof, have tended to use ballpoint or roller ball pen technology. Aside from not having to contend with the above-noted inconveniences, the ballpoint or roller ball type of writing instrument has the advantage that it lends itself to pressing through several forms, as to impress a duplicate on an underlying form. The ballpoint/roller ball technology is preferred in that it also lends itself to the facilitated replacement of spent ink-carrying cartridges. Alternatively, this type of technology is usually inexpensive enough that the writing instruments can be disposed of after the ink supply therein is spent.

When making a selection of a writing instrument, one heretofore has had to choose between the elegance and, what some believe to be the incomparable writing characteristics, of a fountain pen, and the more universal ballpoint/roller ball pen technology which offers the above-noted advantages.

SUMMARY OF THE INVENTION

In one form, the invention is directed to a writing instrument having a barrel and a tip section through which a writing substance is applied by the writing instrument. The barrel has a shape that is graspable in the hand of a user so as to allow the tip section to be moved against a surface to controllably supply a writing substance thereto. The tip section has a tip assembly that one of (a) is a nib of a fountain pen and (b) simulates in appearance a nib of a fountain pen. The tip section has a barrel end and a writing substance applying end. The writing instrument further includes a writing substance applying assembly. The writing substance applying assembly has a surface contacting end and a supply of a writing substance that is applied to a surface by bearing the surface contacting end against the surface. The writing substance applying assembly functions to supply the writing substance to a surface without the tip section performing a normal nib function for a fountain pen.

In one form, the tip assembly has one of: (a) a slit that defines first and second elements that simulate the appearance of tines on a nib of a fountain pen and (b) a simulation of a slit that corresponds to a slit that defines spaced tines on a nib of a fountain pen.

The tip assembly may further have one of: (a) a hole and (b) a simulation of a hole that is contiguous with one of (i) the slit and (ii) the simulation of a slit. The hole corresponds to a hole that is contiguous with a nib slit on a fountain pen.

In one form, the one of the hole or simulation thereof is round.

In one form, the one of the slit and simulation of a slit extends along a first line, with the one of the hole and simulation of a hole having a central axis. The central axis is substantially orthogonal to the first line.

In one form, the barrel has a length with a central axis and the barrel defines an annular, axially facing shoulder at a juncture between the tip section and barrel corresponding to a juncture between a tip section and barrel on a fountain pen.

In one form, the barrel has a diameter that varies to define a contoured surface extending one of (a) axially towards and to adjacent the annular, axially facing shoulder and (b) axially up to the annular, axially facing shoulder to facilitate gripping by a user.

The contoured surface may have at least a portion that is concave, opening radially outwardly.

In one form, the contoured surface decreases in diameter from a first location axially toward the annular, axially facing surface to a neck and increases in diameter between the neck and the annular, axially facing surface.

In one form, the writing substance applying assembly has a ball element and a supply of writing material that is applied by moving the ball element against a surface.

In one form, the tip assembly has a free end and the writing substance applying assembly includes an aperture at which the ball element is exposed. The aperture is at the writing substance applying end of the tip section.

In one form, the writing substance applying assembly includes a casing having a free end at which the aperture is formed. The free end of the casing extends to beyond the free end of the tip assembly.

In one form, the casing has a portion with a diameter that diminishes progressively toward the free end of the casing.

In one form, the portion of the casing extends to beyond the free end of the tip assembly.

The tip assembly may taper in diameter up to the free end of the tip assembly.

In one form, a portion of the tip assembly that simulates a nib decreases in diameter up to the free end of the tip assembly.

In one form, the tip section one of (a) is a feed assembly for a writing substance of a fountain pen and (b) simulates an appearance of a feed assembly for a writing substance on a fountain pen.

In one form, the writing instrument further includes a cap that is releasably connected to the barrel.

In one form, at least a part of the writing substance applying assembly is replaceable to replenish a supply of a writing substance.

Alternatively, the writing substance applying assembly may be refillable with a writing substance.

The invention is further directed to a writing instrument having a barrel and a tip section through which a writing substance is applied by the writing instrument. The barrel has a shape that is graspable in the hand of a user so as to allow the tip section to be moved against a surface to controllably apply a writing substance thereto. At least one of the barrel and tip section has configurational aspects that give an appearance that the writing instrument is a fountain pen that applies a writing substance through a fountain pen nib. The writing instrument further includes a writing substance applying assembly including a surface contacting end and a supply of a writing substance that is applied to a surface by bearing the surface contacting end against a surface without requiring a functional fountain pen nib.

In one form, the surface contacting end is defined by a ball element.

In one form, the tip section includes a functional nib.

Alternatively, the tip section includes a tip assembly that simulates in appearance a nib on a fountain pen.

In one form, the configurational aspects are on each of the barrel and tip section.

The tip section may include a functional feed assembly for a writing substance on a fountain pen.

Alternatively, the tip section may include a simulation of a feed assembly for a writing substance on a fountain pen.

The writing instrument may include a cap that is releasably connected to the barrel.

In one form, the tip assembly has a free end that is truncated and the surface contacting end of the writing substance applying assembly is exposed past the free end of the tip assembly.

In one form, the tip assembly simulates in appearance a nib on a fountain pen with a truncation defining a free end. The surface contacting end of the writing substance applying assembly is exposed beyond the truncated free end.

DETAILED DESCRIPTION OF THE DRAWINGS

Figure 1:
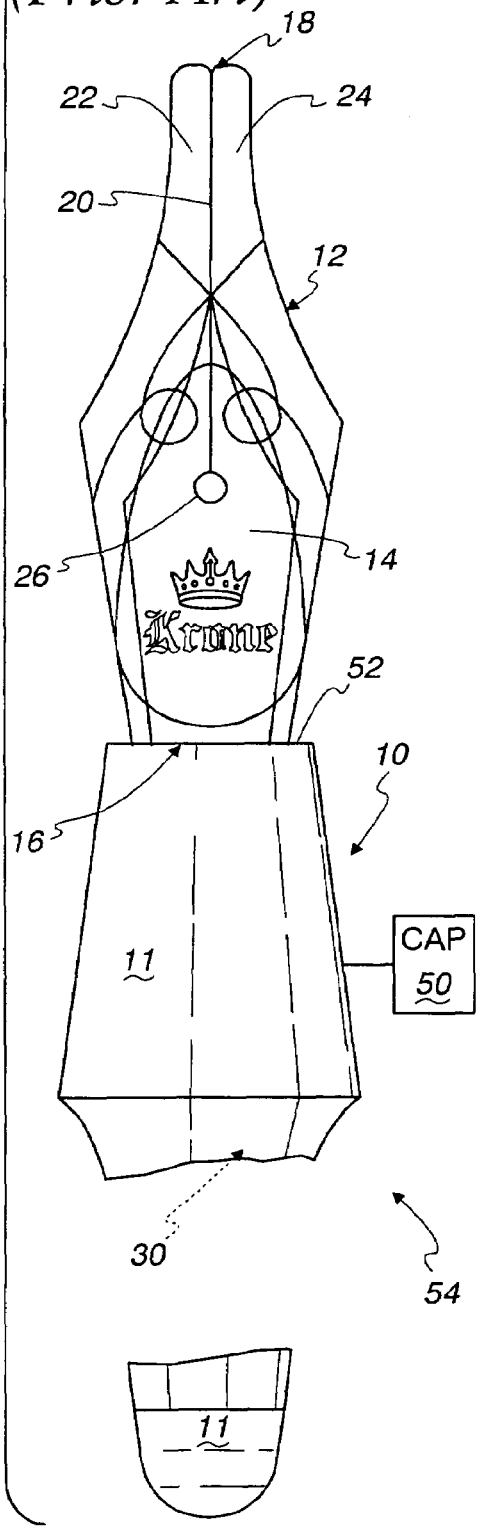
Fig. 1 (Prior Art)
FIG. 1 is a fragmentary, plan view of a conventional fountain pen.
Figure 2:
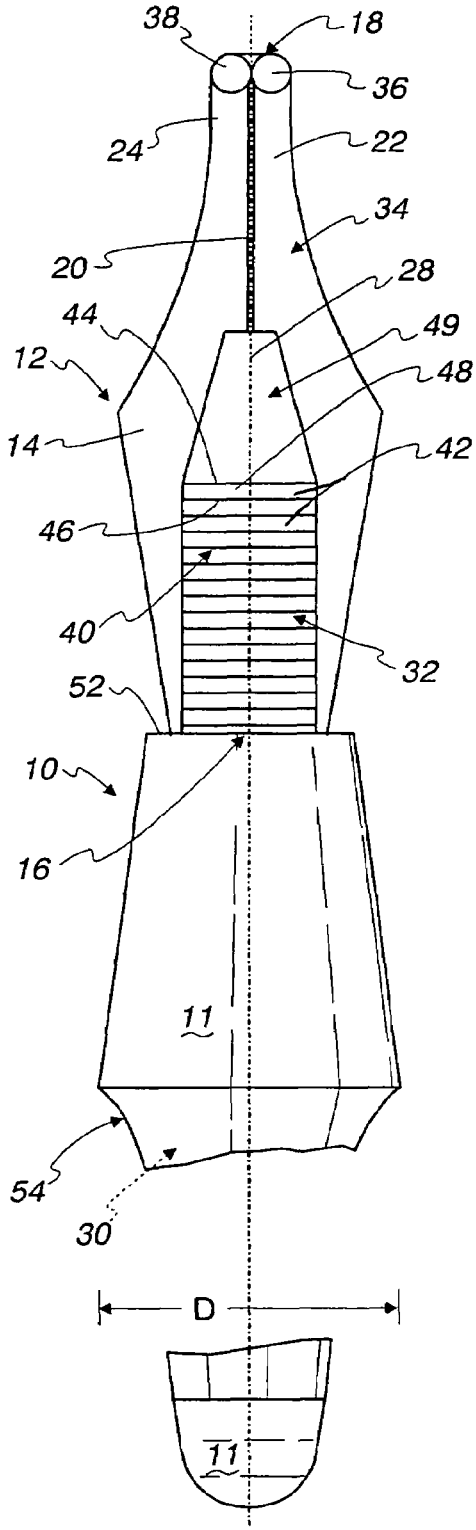
Fig. 2 (Prior Art)
FIG. 2 is a fragmentary, bottom view of the fountain pen in FIG. 1.

Referring initially to FIGS. 1 and 2, one conventional form of fountain pen is shown at 10. The fountain pen 10 consists of a barrel 11 on which a tip section 12 is provided. The tip section 12 includes a tip assembly in the form of nib 14, that may be made from any of myriad different metals. The nib 14 has a diamond shape that is truncated at a barrel end 16 and writing end 18.

A slit 20 divides the writing end 18 of the nib 14 into identical tines 22,24. A hole 26 is formed through the nib 14, mid length relative to a lengthwise axis 28 for the fountain pen 10. The hole 26 is contiguous with the slit 20. The hole 26 is circular with a central axis that is transverse to the line of the slit 20.

An ink reservoir 30 is defined in the barrel 11. Through a feed assembly at 32, ink from the reservoir 30 is delivered gravitationally to the underside 34 of the nib 14, adjacent to the writing end 18. The tines 22,24 have projecting ink applying elements 36,38, respectively thereon. The ink applying elements 36,38 have exposed, rounded surfaces that directly contact a surface upon which ink is to be applied to cause an appropriate distribution pattern of ink thereon.

There are virtually a limitless number of different types of feed assemblies 32 and nibs 14 available in the writing industry. The details of construction thereof are not critical to an understanding of the present invention and will not be described herein.

Fountain pens, such as the pen 10, are readily recognizable primarily by the configuration of the tip section 12, and principally the nib 14 thereon. Identification can also readily be made by reason of the configuration of the feed assembly 32. As shown in FIG. 2, the feed assembly 32, in addition to the mechanism that resides within the barrel 11, has an exposed portion 40 defined by a comb-like arrangement of walls 42. The walls 42 each have flat, oppositely facing surfaces 44,46. The walls 42 are spaced at regular intervals along the axis 28 to produce the general appearance shown in FIG. 2. The underside edges 48 of the walls 42 are convex. The feed assembly 32 further has a portion at 49 that converges from the forwardmost wall 42 towards the writing end 18, producing a truncated triangular shape at the end thereof, as viewed from the underside of the writing instrument 10.

Typically, the fountain pen 10 will include a separable cap 50 (FIG. 1) that is frictionally joined to the barrel 11, or alternatively joined thereto as through cooperating threaded connecting parts on the barrel 11 and cap 50.

Fountain pens are also readily identifiable by other configurational aspects thereof. Typically, the diameter D of the barrel 11 is greater than that for other conventional instruments, such as pencils and ballpoint/roller ball pens. This larger diameter produces a dominant transition step between the barrel 11 and tip section 12. The smaller diameter tip section 12 causes a prominent annular, axially facing shoulder 52 to be formed at this transition location. Due to the larger diameter of the barrel 11, compared to other writing instruments, typically the gripping portion 54 of the barrel 11 will be contoured to accommodate the fingertips of the user that is gripping the barrel 11.

Figure 3:
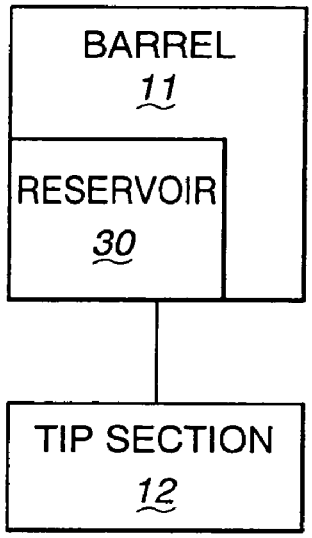
Fig. 3 (Prior Art)
FIG. 3 is a schematic representation of one form of conventional fountain pen.
Figure 4:
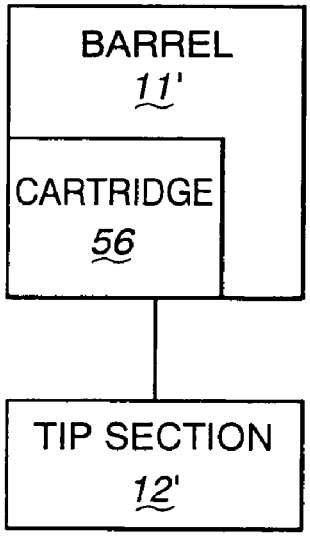
Fig. 4 (Prior Art)
FIG. 4 is a view as in FIG. 3 of another form of conventional fountain pen.

As shown in FIG. 3, the barrel 11 may have an integrally formed reservoir 30 which communicates with the tip section 12. Alternatively, as shown in FIG. 4, the reservoir may be defined by a cartridge 56, which is carried by a corresponding barrel 11'. The cartridge 56 communicates ink to the tip section 12', corresponding to the tip section 12.

As noted above, while the configuration of the tip section 12, including the nib 14 and feed assembly 32, and barrel 11 may vary significantly from what is shown in FIGS. 1 and 2, these components have the same general configurational aspects which identify the writing instrument as a fountain pen to those viewing the same.

Figure 5:
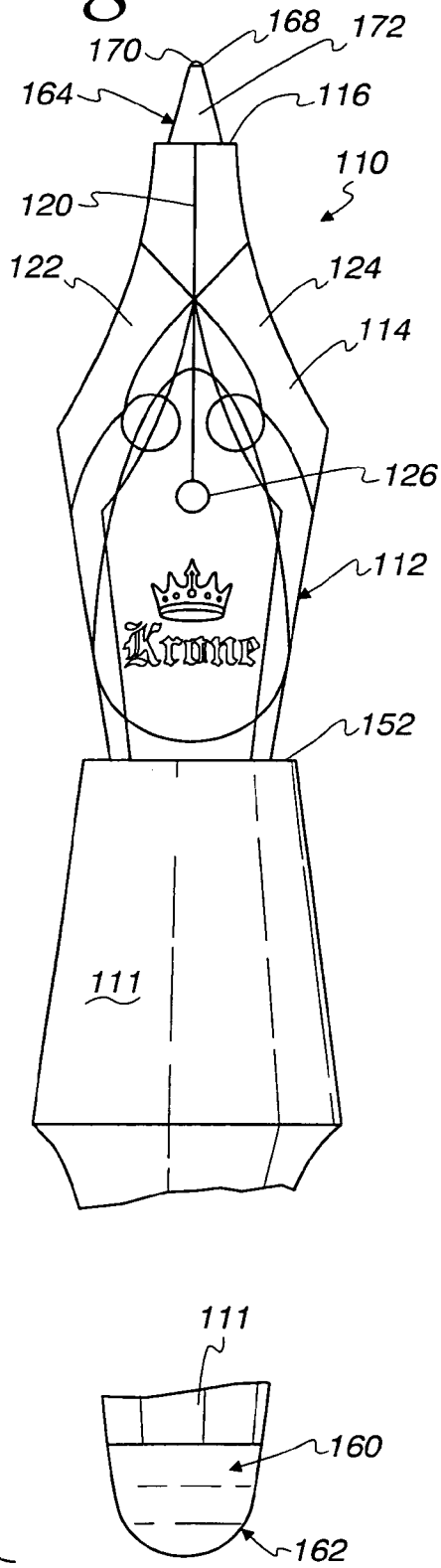
FIG. 5 is a view as in FIG. 1 of a writing instrument, made according to the present invention, and including a barrel with an associated tip member.
Figure 6:
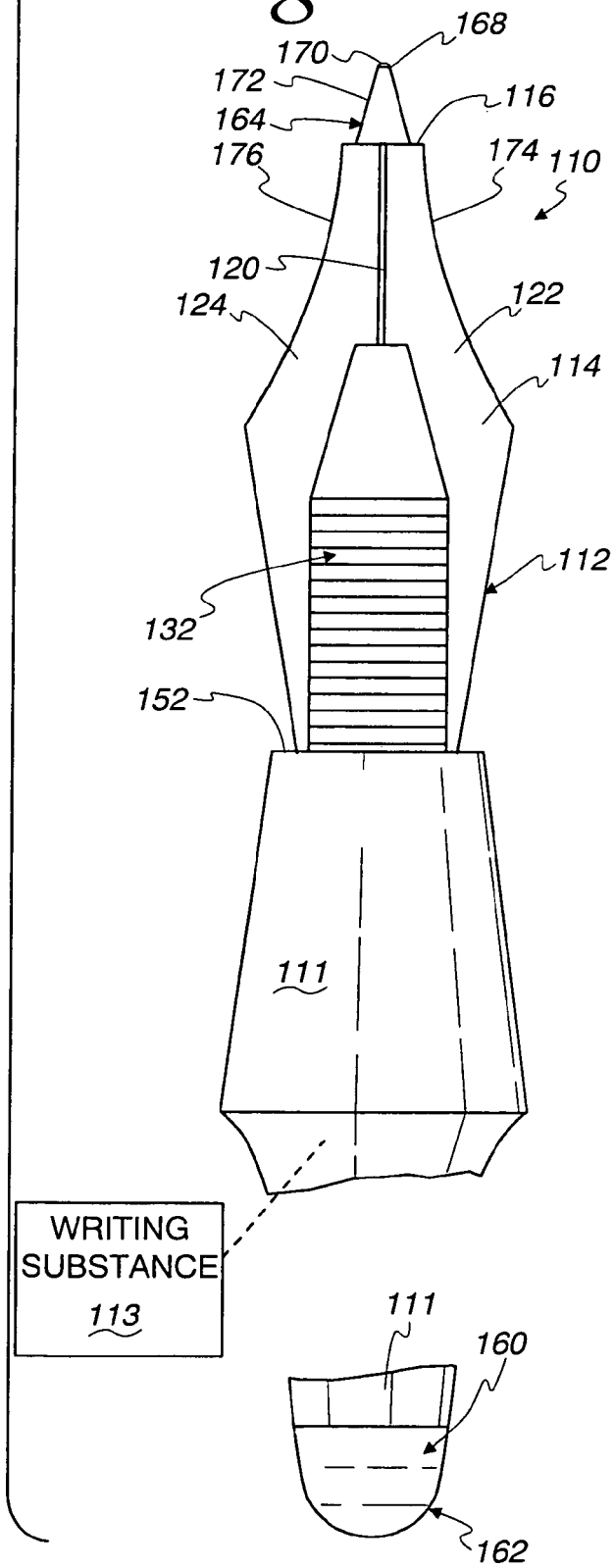
FIG. 6 is a view as in FIG. 5 with the writing instrument rotated through 180° about a lengthwise axis.
Figure 7:
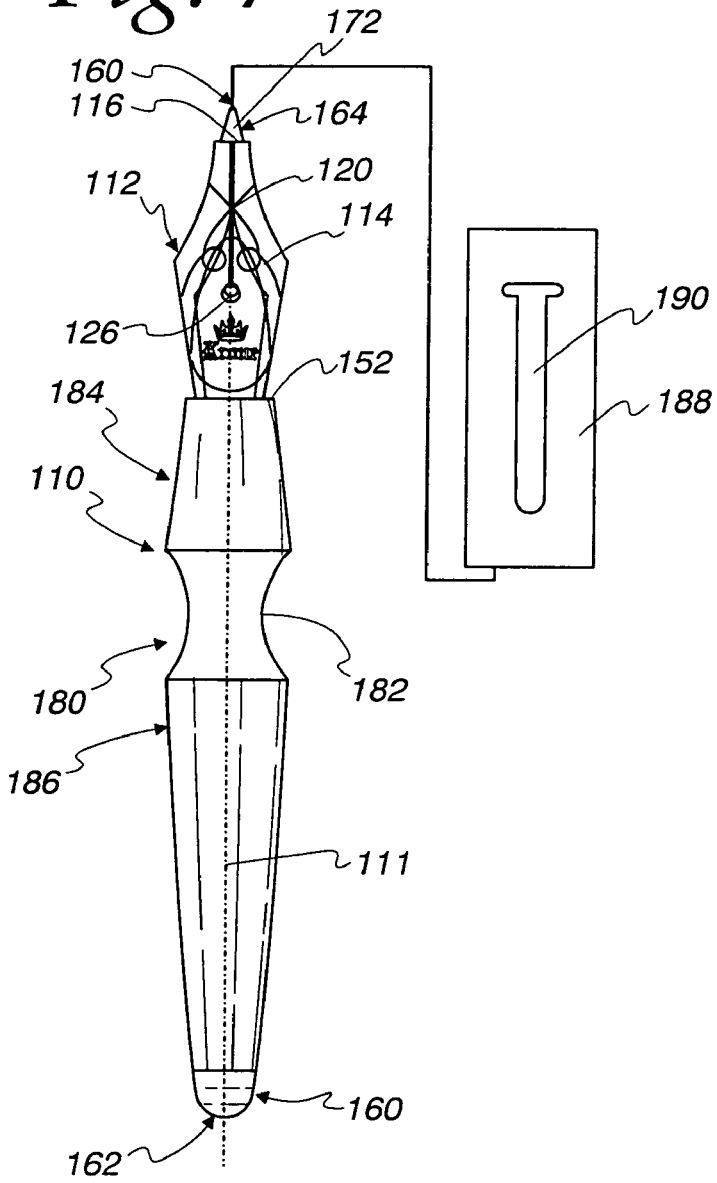
FIG. 7 is a reduced, exploded, plan view of the writing instrument in FIGS. 5 and 6, including a removable cap on the barrel.

As shown in FIGS. 5-7, the invention contemplates a writing instrument, as shown at 110, with a barrel 111 and tip section 112, having configurational aspects that give the appearance to an observer that the writing instrument 110 is a fountain pen. In actuality, a writing substance 113, contained either partially or entirely within the barrel 111, is caused to be applied through the writing instrument 110 through a mechanism other than through the depicted fountain pen components, i.e. a tip assembly in the form of a nib 114 and having axially spaced barrel and writing substance applying ends.

In this embodiment, with one minor exception, the writing instrument 110 has, in appearance, the same components as the fountain pen 10; those being, in addition to others described below, a similarly-shaped barrel 111 and nib 114. In this case, the nib 114 is truncated to define a forwardmost free end 116. Of course, the configuration of the writing instrument 110 need not be as shown in FIGS. 5 and 6. The writing instrument 110 may have any configurational aspects that are typical of fountain pens.

The most prominent configurational aspect that identifies a fountain pen is the shape of the nib 114, including its overall shape, and the provision of a slit 120, to define spaced tines 122, 124, and circular hole 126 therein that is contiguous with the slit 120. The shape of the barrel 111 is also a dominant feature, as are the feed assembly 132, the stepped transition at the juncture between the tip section 112 and barrel 111 and the axially facing shoulder 152 defined thereat.

Figure 8:
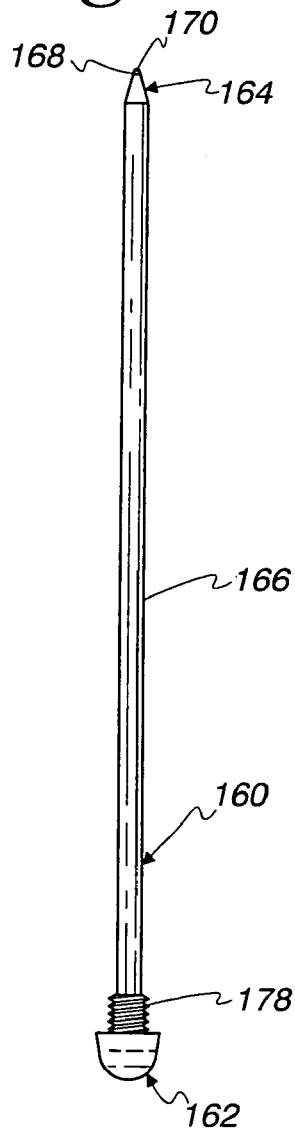
FIG. 8 is a plan view of a writing substance applying assembly that can be removably attached to the barrel in FIG. 5 and defines a surface contacting end through which a writing substance is applied.

In this embodiment, as shown more specifically in FIGS. 7 and 8, a writing substance applying assembly 160 is self-contained and releasably attachable to the barrel 111. The writing instrument applying assembly 160 consists of a mounting end 162 and an opposite surface contacting end 164 defining part of the tip section 112. A conduit/case 166 retains a supply of the writing substance 113 (FIG. 6) and communicates the same to the surface contacting end 164 without requiring contact between the writing substance and fountain pen components i.e. the nib, for operation. As seen also in FIGS. 5 and 6, the conduit/case 166 has an aperture 168 at its surface contacting end 164 through which a ball element 170 is exposed. The diameter of the aperture 168 is less than that of the ball element 170 so that a portion of the writing ball 170 can be exposed without allowing the entire ball element 170 to pass therethrough.

The use of a writing ball element 170 is common to ballpoint and roller ball technology. In each, a layer of the writing substance 113 is adhered to the writing ball 170 and applied to a surface as the ball element 170 is advanced against that surface. Further detail of the writing substance applying assembly 160 is not critical to the present invention.

It is preferred that the surface contacting end 164 have a part 172 that projects to slightly beyond the truncated free end 116 of the nib 114 so as to be engageable with a surface without interference from the nib 114. At the same time, the degree of projection is preferably minimized to the point that the projecting part 172 of the surface contacting end 164 is generally close in appearance to the corresponding end of an actual fountain pen, without the nib truncation. In this embodiment, the projecting part 172 tapers towards the aperture 168 to follow generally the contour of the nib, which is defined by two curved edges 174,176 which converge towards the free end 116. The free end 116 of the nib 114 has a width that is greater than the width/diameter of the projecting part 172 at the free end 116. The projecting part 172 tapers progressively in width/diameter from the free end 116 to the surface contacting free end on the projecting part 172.

The writing substance applying assembly 160 is shown to be removably attached to the barrel 111 by incorporating a threaded connecting part 178, which can be engaged with cooperating threads around a bore (not shown) in the barrel 111. This arrangement facilitates assembly and disassembly of the writing substance applying assembly 160 in the event that replacement is desired, as when the writing substance 113 is exhausted therefrom. The conduit/case 166 may be removable from the mounting end 162 for replacement, or may be permanently attached thereto, whereby the entire structure shown in FIG. 8 must be removed and replaced as a unit.

Since the barrel 111 shown has a substantial girth, typical of fountain pens, to facilitate grasping thereof in the hand of a user, the barrel 111 may be contoured at a finger gripping portion 180. More specifically, as shown in FIG. 7, the barrel diameter varies to define a contoured surface extending either axially towards and to adjacent the annular, axially facing shoulder 52, or axially up to the annular, axially facing shoulder 52.

In the depicted embodiment, the finger gripping portion 180 has an annular surface at 182 that is concave, opening radially outwardly. This surface 182 is spaced from the shoulder 52, thereby defining a neck between two larger diameter barrel portions 184,186, on axially opposite sides thereof. From the neck 182, the barrel 111 increases and then decreases in diameter toward the shoulder 152.

A cap 188 is releasably attached over the tip section 112 and is secured to the barrel 111 through appropriate frictionally or threadably engaging structure. A clip 190 on the cap 188 facilitates mounting, as on the edge of a user's pocket.

With the structure as described above, the writing instrument 110 has the appearance of a fountain pen, but incorporates the functional aspects of ballpoint/roller ball technology. It should be understood that the components of the writing instrument 110 that give it the appearance of a fountain pen could be a) actual functioning fountain pen components, b) functioning fountain pen components that have been disabled, or c) simply simulated fountain pen components. In the first case, for example, it is possible to take an existing fountain pen and retrofit the same with an appropriate writing substance applying assembly 160. With simulated components, the only critical aspect is the functionality of the writing substance supplying assembly 160, with the remainder of the structure serving primarily as ornamentation.

Figure 9:
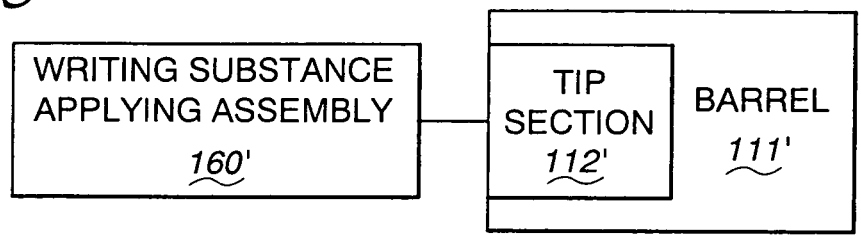
FIG. 9 is a schematic representation of a barrel and writing substance applying assembly according to the present invention.

It is not necessary that the writing substance applying assembly 160 use either ballpoint or roller ball technology. In FIG. 9, the writing substance applying assembly is shown generically at 160' to be any type of applicator, alternatively in the nature of a felt wicking system, lead, etc., associated with a barrel 111', with the barrel 111' and/or tip section 112' preferably having the visual aspects of a fountain pen.

Figure 10:
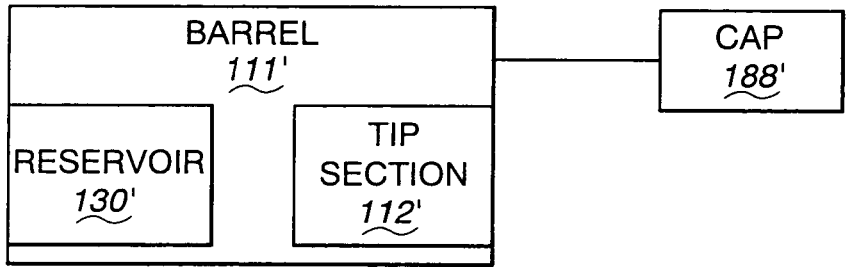
FIG. 10 is a schematic representation of one form of writing instrument, according to the prevent invention.

As shown in FIG. 10, the generic showing of the barrel 111' and tip section 112', contemplated by the invention, may take virtually any configuration appropriate to a fountain pen and that serves to identify the writing instrument as a fountain pen. A suitable cap 188' is provided on the barrel 111'. The barrel 111' is shown to have an integral reservoir in the form of a receptacle for a cartridge, or the like, as shown at 130'. In this embodiment, the tip section 112' is shown as an integral part of the barrel 111'.

Figure 11:
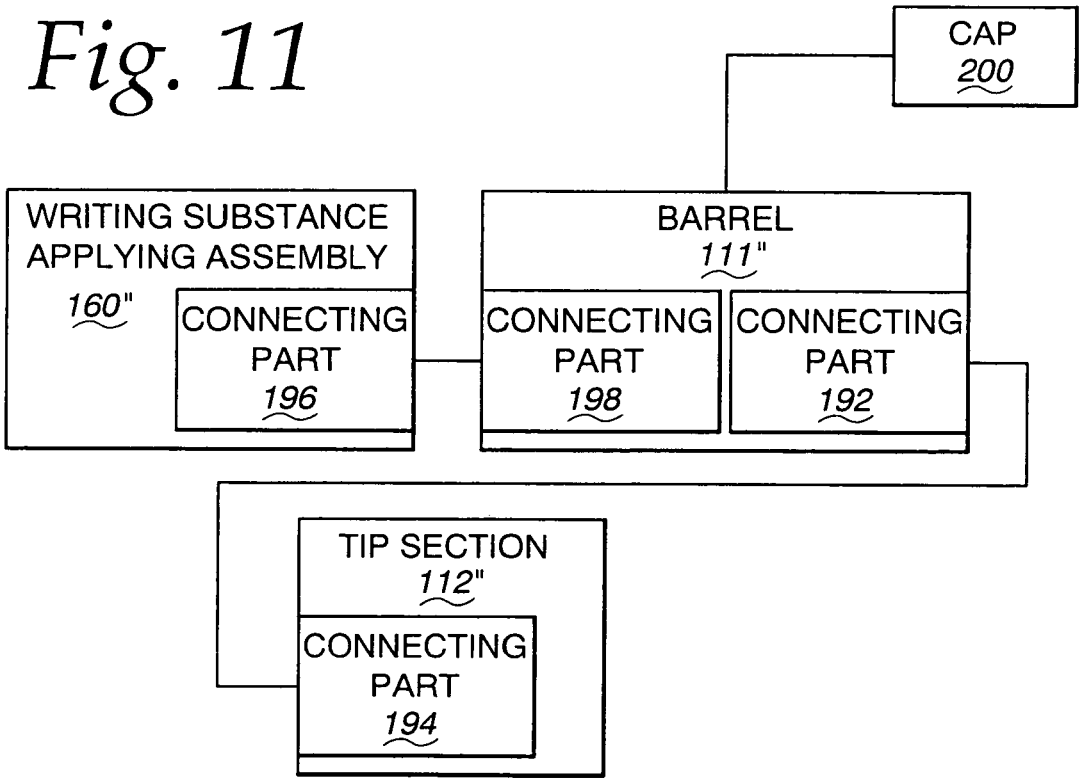
FIG. 11 is a view as in FIG. 10 of a modified form of writing instrument, according to the prevent invention.

In FIG. 11, a modified form of writing instrument is shown, according to the present invention, wherein the tip section 112" is shown as a section that is separate, and potentially separable, from the barrel 111". Connecting parts 192,194 on the barrel 111" and tip section 112" cooperate to unite the barrel 111" and tip section 112". A separate writing substance applying assembly 160" is integrated with the barrel 111" through cooperating connecting parts 196,198 on the writing substance applying assembly 160" and barrel 111", respectively. An optional cap 200 is incorporated.

The various different structures are shown schematically in FIGS. 8-10 to encompass different combinations of components contemplated by the invention. For example, the various components may be permanently joined as during an assembly operation. Alternatively, the various parts can be separately formed and joined either permanently or releasably. Further, the generic showing is intended to encompass all different types of operating mechanisms as well as configurations for the inventive writing instrument. The specific components, and their shapes shown in FIGS. 5-7, are intended to be illustrative only. Any configurational component that is identified with a fountain pen construction can be utilized and is contemplated by the present invention.

While the invention has been described with particular reference to the drawings, it should be understood that various modifications could be made without departing from the spirit and scope of the present invention.

The invention claimed is:

1. A writing instrument comprising:

a barrel;

a tip section through which a writing substance is applied, the barrel having a shape that is graspable in the hand of a user so as to allow the tip section to be moved against a surface to controllably apply a writing substance thereto, the tip section comprising a tip assembly that one of (a) comprises a nib of a fountain pen and (b) comprises a portion that simulates in appearance a nib of a fountain pen, the tip section having a barrel end and a writing substance applying end; and a writing substance applying assembly, the writing substance applying assembly comprising a surface contacting free end and a supply of a writing substance that is applied to a surface by bearing the surface contacting free end against a surface, the writing substance applying assembly functional to communicate the supply of writing substance along the tip assembly in a direction from the barrel end of the tip section toward the writing substance applying end to the surface contacting free end and to against a surface without requiring that the writing substance directly contact the nib or the portion that simulates in appearance a nib, wherein at least a part of the writing substance applying assembly is replaceable to replenish a supply of writing substance, the at least part of the writing substance applying assembly self-contained and releasably attached to the barrel, wherein the nib or portion that simulates in appearance a nib has a free end with a first width, the writing substance applying assembly has a part that projects to beyond the free end of nib or the portion that simulates in appearance a nib to the surface contacting free end with a second width at the free end of the nib or portion that simulates in appearance a nib that: a) is not greater than the first width of the free end of the nib or portion that simulates in appearance a nib; and b) tapers in width/diameter from the free end of the nib or portion that simulates in appearance a nib to the surface contacting free end, wherein the at least part of the writing substance applying assembly that is releasably attached to the barrel includes the surface contacting free end.

2. The writing instrument according to claim 1 wherein the tip assembly comprises one of: (a) a slit that defines first and second elements that simulate the appearance of tines on a nib of a fountain pen and (b) a simulation of a slit that corresponds to a slit that defines spaced tines on a nib of a fountain pen and the second width is less than the first width.

3. The writing instrument according to claim 2 wherein the tip assembly comprises one of: (a) a hole and (b) a simulation of a hole that is contiguous with one of (i) the slit and (ii) the simulation of a slit, the hole corresponding to a hole that is contiguous with a nib slit on a fountain pen.

4. The writing instrument according to claim 3 wherein the one of the hole and simulation of a hole is round.

5. The writing instrument according to claim 3 wherein the one of the slit and simulation of a slit extends along a first line, the one of the hole and simulation of a hole has a central axis, and the central axis is substantially orthogonal to the first line.

6. The writing instrument according to claim 1 wherein the barrel has a length with a central axis and the barrel defines an annular, axially facing shoulder at a juncture between the tip section and barrel corresponding to a juncture between a tip section and barrel on a fountain pen.

7. The writing instrument according to claim 6 wherein the barrel has a diameter that varies to define a contoured surface extending one of (a) axially towards and to adjacent the annular, axially facing shoulder and (b) axially up to the annular, axially facing shoulder, to facilitate gripping by a user.

8. The writing instrument according to claim 7 wherein the contoured surface comprises at least a portion that is concave opening radially outwardly.

9. The writing instrument according to claim 7 wherein the contoured surface decreases in diameter from a first location axially toward the annular, axially facing surface to a neck and increases in diameter between the neck and the annular, axially facing surface.

10. The writing instrument according to claim 1 wherein the writing substance applying assembly comprises a ball element and a supply of writing material that is applied by moving the ball element against a surface.

11. The writing instrument according to claim 10 wherein the tip assembly has a free end, the writing substance applying assembly comprises an aperture at which the ball element is exposed, and the aperture is at the writing substance applying end of the tip section.

12. The writing instrument according to claim 1 wherein the tip section one of (a) is a feed assembly for a writing substance of a fountain pen and (b) simulates an appearance of a feed assembly for a writing substance on a fountain pen.

13. The writing instrument according to claim 1 wherein the writing instrument further comprises a cap that is releasably connected to the barrel.

14. The writing instrument according to claim 1 wherein the at least a part of the writing substance applying assembly is replaceable to replenish a supply of a writing substance, the writing substance applying assembly self-contained and releasably attached to the barrel through a threaded connection.

15. The writing instrument according to claim 1 wherein the writing substance applying assembly is refillable with a writing substance.

16. A writing instrument:

a barrel;

a tip section through which a writing substance is applied, the barrel having a shape that is graspable in the hand of a user so as to allow the tip section to be moved against a surface to controllably apply a writing substance thereto, the tip section comprising a tip assembly that one of (a) is a nib of a fountain pen and (b) comprises a portion that simulates in appearance a nib of a fountain pen, the tip section having a barrel end and a writing substance applying end, the nib capable of directly contacting and communicating a writing substance in a direction from the barrel end of the tip section toward the writing substance applying end; and a writing substance applying assembly, the writing substance applying assembly comprising a surface contacting end and a supply of a writing substance that is applied to a surface by bearing the surface contacting end against a surface the writing substance applying assembly functional to communicate the supply of writing substance along the tip assembly in a direction from the barrel end of the tip section toward the writing substance applying end to the surface contacting end and to against a surface without requiring that the writing substance directly contact the nib or the portion that simulates in appearance a nib, wherein at least a part of the writing substance applying assembly is replaceable to replenish a supply of writing substance, the at least part of the writing substance applying assembly self-contained and releasably attached to the barrel, wherein the writing substance applying assembly comprises a ball element and a supply of writing material that is applied by moving the ball element against a surface, wherein the tip assembly has a free end, the writing substance applying assembly comprises an aperture at which the ball element is exposed, and the aperture is at the writing substance applying end of the tip section, wherein the writing instrument has a length and the writing substance applying assembly comprises a self-contained casing extending over a majority of the length of the writing instrument and having a free end at which the aperture is formed and the free end of the casing extends to beyond the free end of the tip assembly.

17. The writing instrument according to claim 16 wherein the casing has a portion with a diameter that diminishes progressively toward the free end of the casing.

18. The writing instrument according to claim 17 wherein the portion of the casing extends to beyond the free end of the tip assembly.

19. The writing instrument according to claim 18 wherein the nib or portion that simulates in appearance a nib has a free end with a first width, the writing substance applying assembly has a part that projects to beyond the free end of the nib or portion that simulates in appearance a nib to the surface contacting free end with a second width at the free end of the nib or portion that simulates in appearance a nib that: a) is not greater than the first width of the free end of the nib or portion that simulates in appearance a nib; and b) tapers in width/diameter from the free end of the nib or portion that simulates in appearance a nib to the surface contacting free end.

20. The writing instrument according to claim 18 wherein a portion of the tip assembly that simulates a nib decreases in diameter up to the free end of the tip assembly.

21. A writing instrument comprising:

a barrel;

a tip section through which a writing substance is applied by the writing instrument, the barrel having a shape that is graspable in the hand of a user so as to allow the tip section to be moved against a surface to controllably apply a writing substance thereto, the tip section comprising a tip assembly comprising at least one of: (a) a slit that defines first and second elements that simulate the appearance of tines on a simulated nib of a fountain pen; and (b) a simulation of a slit that corresponds to a slit that defines spaced tines on a simulated nib of a fountain pen a writing substance applying assembly comprising a surface contacting end and a supply of a writing substance that is communicated to the surface contacting end to be applied to a surface by bearing the surface contacting end against a surface without requiring a functional fountain pen nib.

22. The writing instrument according to claim 21 wherein the surface contacting end is defined by a ball element.

23. The writing instrument according to claim 21 wherein the barrel has configurational aspects that give the barrel the appearance of a barrel on a fountain pen.

24. The writing instrument according to claim 21 wherein the tip section comprises a simulation of a feed assembly for a writing substance on a fountain pen.

25. The writing instrument according to claim 21 wherein the writing instrument further comprises a cap that is releasably connected to the barrel.

26. The writing instrument according to claim 21 wherein the tip assembly has a free end that is truncated and the surface contacting end of the writing substance applying assembly is exposed past the free end of the tip assembly.

27. The writing instrument according to claim 21 wherein the simulated nib has a truncation defining a free end, and the surface contacting end of the writing substance applying assembly is exposed beyond the truncated free end.

28. A writing instrument comprising:

an elongate barrel having a length;

a tip section through which a writing substance is applied, the barrel having a shape that is graspable in the hand of a user so as to allow the tip section to be moved against a surface to controllably apply a writing substance thereto, the tip section comprising a tip assembly that one of (a) is a nib of a fountain pen and (b) comprises a portion that simulates in appearance a nib of a fountain pen, the tip section having a barrel end and a writing substance applying end, the nib capable of directly contacting and communicating a writing substance in a direction from the barrel end of the tip section toward the writing substance applying end; and a writing substance applying assembly, the writing substance applying assembly comprising a surface contacting end and a supply of a writing substance that is applied to a surface by bearing the surface contacting end against a surface, the writing substance applying assembly functional to communicate the supply of writing substance along the tip assembly in a direction from the barrel end of the tip section toward the writing substance applying end to the surface contacting end and to against a surface without requiring that the writing substance directly contact the nib or the portion that simulates in appearance a nib, wherein at least a part of the writing substance applying assembly is replaceable to replenish a supply of a writing substance, the at least part of the writing substance applying assembly self-contained and releasably attached to the barrel, wherein the writing instrument has an overall length between a first end at which the surface contacting end is defined and a second end, the first and second ends of the writing instrument spaced from each other lengthwise of the barrel a first distance, the self-contained substance applying assembly extends from the second end of the barrel to the first end at which the surface contacting end is located substantially fully over the first distance, the self-contained substance applying assembly separable as a unit from the barrel.

29. The writing instrument according to claim 28 wherein the self-contained substance applying assembly has threads thereon to allow the self-contained substance applying assembly to be threadably connected at the second end of the writing instrument to allow the self-contained substance applying assembly to be separated as a unit from the barrel.

30. A writing instrument comprising:

a barrel;

a tip section through which a writing substance is applied by the writing instrument, the barrel having a shape that is graspable in the hand of a user so as to allow the tip section to be moved against a surface to controllably apply a writing substance thereto, at least one of the barrel and tip section having configurational aspects that give an appearance that the writing instrument is a fountain pen that applies a writing substance through a fountain pen nib; and a writing substance applying assembly comprising a surface contacting end and a supply of a writing substance that is communicated to the surface contacting end to be applied to a surface by bearing the surface contacting end against a surface without requiring a functional fountain pen nib, wherein at least a part of the writing substance applying assembly is replaceable to replenish a supply of a writing substance, the writing substance applying assembly self-contained and releasably attached to, and separable from the barrel as a unit, wherein the writing instrument has a first end at which the surface contacting end is defined and a second end, the first and second ends of the writing instrument spaced from each other lengthwise of the barrel a first distance defining an overall length for the writing instrument, the self-contained substance applying assembly extends from the second end of the barrel to the first end at which the surface contacting end is located substantially fully over the first distance.

31. The writing instrument according to claim 30 wherein the self-contained substance applying assembly has threads thereon to allow the self-contained substance applying assembly to be threadably connected at the second end of the writing instrument.

* * * * *

UNITED STATES PATENT AND TRADEMARK OFFICE

CERTIFICATE OF CORRECTION

PATENT NO. : 7,594,774 B2
APPLICATION NO. : 11/024183
DATED : September 29, 2009
INVENTOR(S) : Robert Kronenberger It is certified that error appears in the above-identified patent and that said Letters Patent is hereby corrected as shown below:

Claim 16 (column 9, lines 52-55), should read as follows:

the writing substance applying assembly comprising a surface contacting end and a supply of a writing substance that is applied to a surface by bearing the surface contacting end against a surface, Claim 21 (column 10, lines 42-47), should read as follows:

the tip section comprising a tip assembly comprising at least one of: (a) a slit that defines first and second elements that simulate the appearance of tines on a simulated nib of a fountain pen; and (b) a simulation of a slit that corresponds to a slit that defines spaced tines on a simulated nib of a fountain pen; and Signed and Sealed this
Thirty-first Day of January, 2012

David J. Kappos

David J. Kappos
*Director of the United States Patent and Trademark Office*